US006706366B2

(12) United States Patent
Meyer et al.

(10) Patent No.: US 6,706,366 B2
(45) Date of Patent: Mar. 16, 2004

(54) CURVED ROOFING TILE STRUCTURE

(76) Inventors: Lyle Meyer, 1137 N. Elm St., West Liberty, IA (US) 52776; Gerald Edson, 1537 W. Harlan Dr., Terre Haute, IN (US) 47802

( * ) Notice: Subject to any disclaimer, the term of this patent is extended or adjusted under 35 U.S.C. 154(b) by 0 days.

(21) Appl. No.: 10/180,349

(22) Filed: Jun. 27, 2002

(65) Prior Publication Data

US 2004/0001938 A1 Jan. 1, 2004

(51) Int. Cl.[7] ..... D06N 7/04; D06N 5/00; B27N 9/00

(52) U.S. Cl. ..... 428/156; 428/141; 428/489; 428/490; 428/491; 428/920

(58) Field of Search ..... 428/156, 920, 428/489, 490, 491, 141

(56) References Cited

U.S. PATENT DOCUMENTS 4,754,589 A * 7/1988 Leth ..... 52/538
5,131,200 A * 7/1992 McKinnon ..... 52/536

* cited by examiner

*Primary Examiner*—Harold Pyon
*Assistant Examiner*—Patricia L. Nordmeyer
(74) *Attorney, Agent, or Firm*—Daniel O'Connor

(57) ABSTRACT

A curved roofing tile which is formed of strong materials so that it may be fabricated in an extra-width configuration. Strengthening ridges and connector ridges are compression molded so the roofing tile forms a one-piece unit. To help the ecology, recycled materials such as rubbers and plastics are combined into a novel formula of high strength, Class A flame retardancy and economy of manufacture.

1 Claim, 1 Drawing Sheet

CURVED ROOFING TILE STRUCTURE

BACKGROUND AND OBJECTS OF THE INVENTION

This application is related in some aspects to pending patent application Ser. No. 09/934,432, filed Aug. 22, 2001, now U.S. Pat. No. 6,558,773.

This invention is generally related to the covering arts and, in particular, to a roofing tile system of greatly improved strength and fire resistance capabilities.

The roofing tiles described herein are of the curved type and are known in some areas of the art as cienda or barrel-type tiles. The overall appearance is that of a Spanish-type tile configuration.

Attempts have been made to reproduce clay-type tiles in the art. Such reproductions have proven to be very costly to manufacture and cumbersome to install. Prior art systems have also lacked the long-life strength and pleasing appearance desired in the art.

Accordingly, it is an object of the present invention to set forth a novel curved roofing tile.

It is a further object of the invention to demonstrate a roofing tile of superior strength such that it may be compression molded in a double-wide configuration for improved installation efficiency.

It is also an object of the invention to show a roofing tile comprised of recycled materails and binders so as to achieve a Class A fire resistance rating, i.e. the highest rating possible in the art.

These and other objects and advantages of the invention will be apparent to those of skill in the art from the description which follows.

PRIOR ART PATENTS AND DESIGNS

U.S. Pat. No. 6,105,328 issued on Aug. 22, 2000 teaches a method and apparatus for manufacturing and installing roof tiles having improved strength and stacking features. The tiles are formed of clay and include ribs for stacking and strength usages.

U.S. Pat. No. 6,314,704 issued in 2001 shows a composite structural building panel and connection system. The patent emphasizes various complex connectors for building wall systems.

In contrast, the present invention shows a curved double-wide roofing tile of a novel curved shape and having materials of higher strength and fire resistance features. The recycled materials utilized in the present invention may be used in a very economical compression molding process. The use of recycled materials results in a great benefit to the ecology.

SUMMARY OF THE INVENTION

An extra-wide roofing tile is made which includes at least two peaks and three valley areas.

Connector-type ridges are included at lateral edges of the tile.

Reinforcing and rain directing channels are positioned at at least three regions of the roofing tile, e.g. top, center and bottom.

The roofing tile may be manufactured using a unique compression molding manufacturing process which enables a very cost effective fabrication in a relatively low-cost plant.

Recycled products such as rubber and plastics are combined with binders resulting in a strong tile which helps the ecology by using materials which would normally be placed in landfills.

BRIEF DESCRIPTION OF THE DRAWING FIGURES

FULL DESCRIPTION OF A PREFERRED EMBODIMENT

Figure 1:
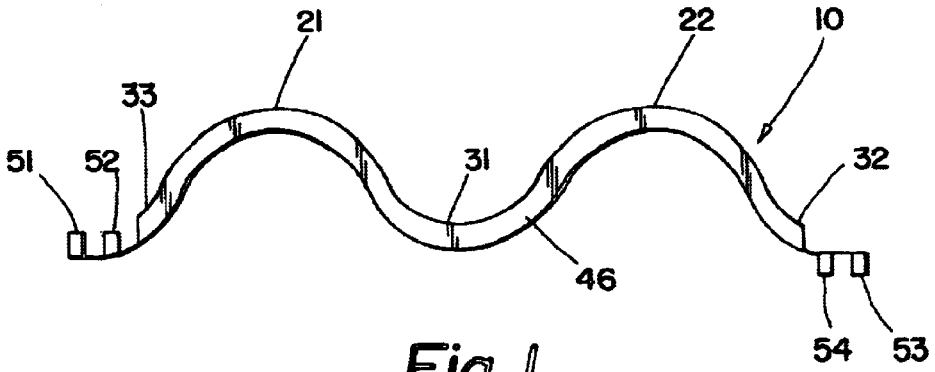
FIG. 1 is an end view of a roofing tile of the invention and shows the dual peaks formed with central and lateral valley sections. End views of the interlocking ridge elements are also shown.

Referring to the drawing FIG. 1, an end view of roofing tile 10 is shown as having dual peaks 21 and 22.

A central valley portion 31 is shown as located between the peaks. Lateral partial valley sections 32 and 33 are also shown in FIG. 1.

As shown, the right lateral valley 32 has ridges 53 and 54 formed on a lower portion thereof. As will be appreciated, these ridges 53 and 54 are used to join with an adjacent roofing tile by utilizing weather-resistant adhesives or other connection elements.

The left lateral valley 33 has ridges 51 and 52 formed on a top portion thereof. These ridges 51 and 52 are used to join and interlock with an adjacent roofing tile—again by adhesive or other equivalent attaching means.

The width of tile 10 is on the order of 12–13 inches wide. This is significant in the art since normal curved clay tiles can only be about six inches wide because of strength and brittleness limitations.

The height of the peaks 21 and 22 is on the order of two inches. This dimension may be varied depending upon the particular application or building construction.

The enhanced width of tile 10 is important since installation time is greatly reduced by reason of fewer tiles required to completely cover the roof of a house or commercial building.

Because of the strength of the materials used in manufacture, even wider tiles, e.g. tiles with three to five peaks, may be constructed.

The particular recycled materials used in the manufacturing process are described later in this specification. The materials have been given a Class A fire resistance rating and are of superior strength.

Figure 2:
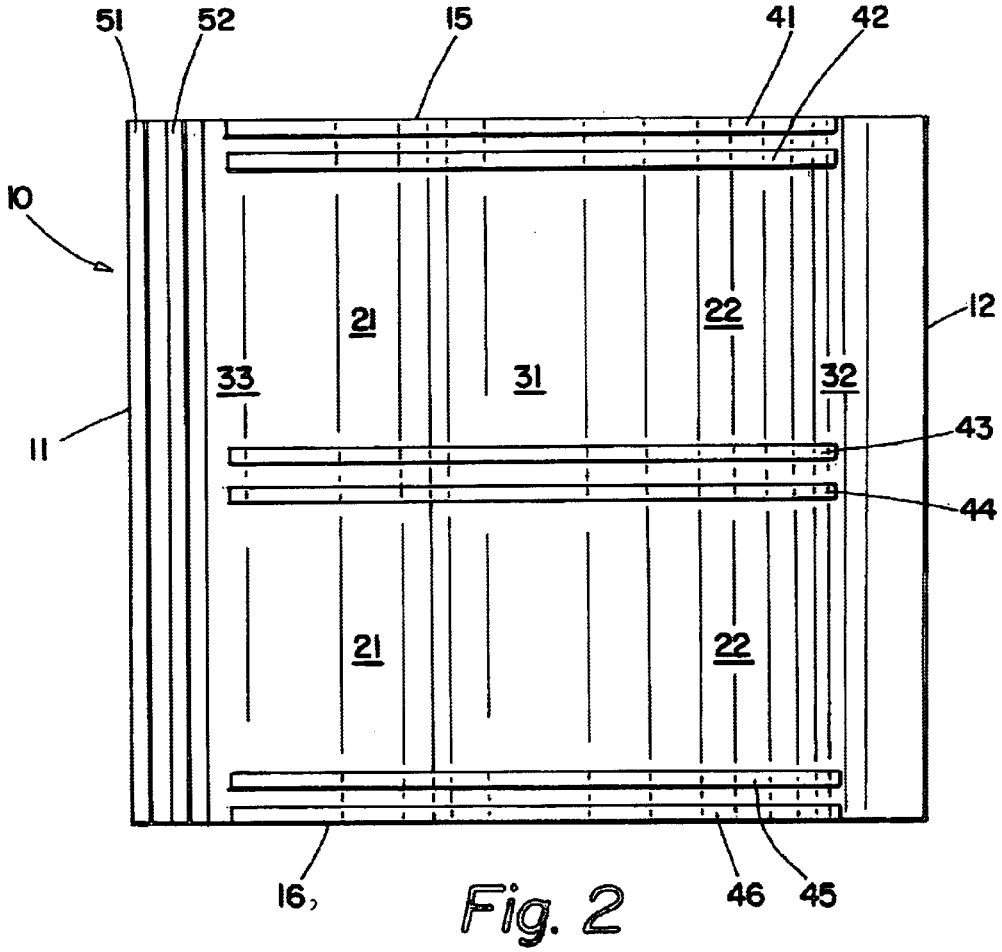
FIG. 2 is a top view of the roofing tile and indicates the peak and valley sections along with the reinforcing ridges which are compression mold formed at top, central and bottom portions of the tile element.

Referring to the top view of FIG. 2, the peak and valley sections 21, 22 and 31–33 respectively are again shown.

Roofing tile 10 has lateral edges 11 and 12 and top and bottom edges 15 and 16.

At the top edge 15, a pair of rib sections 41 and 42 run nearly the entire width of the tile 10. These rib portions serve the purposes of strengthing the tile and providing rain channels to direct rain water to lateral edges of the tile. They may also serve as snow-melting elements which are sometimes attached to roofs in colder environments.

The tile 10 also includes a pair of central ribs 43 and 44. These serve a similar purpose as the upper ribs. It is an important aspect of the invention that all the ribs shown are one-piece molded into the overall tile 10.

Lower ribs 45 and 46 and the top lateral connecting ridges 51 and 52 are also shown in FIG. 2.

Through lengthy experimentation, applicant has found that the following combination of elements is highly effective for use in a compression molding process to produce the desired roofing tile:

EPDM(ethylene propylene diene monomers), scrap from rubber seals or car parts and SBR(styrene butadiene rubber), up to 50% by weight, EVA(ethylene vinyl acetate) and ULDPE(ultra low density polyethylene) at 10–20% by weight, ATH(aluminum tri-hydrate), fire retardant at 35% by weight in combination with 4% by weight zinc oxide, HDPE(high density polyethylene at 10–30% by weight.

In practice, a red clay coloring is added at the time of blending.

The mixture is extruded and the extruded mass is placed into a water cooled compression mold producing the desired roofing tile product. Importantly, the above compound allows the use of compression molding rather than the more complex injection molding processes.

Among the many advantages of the invention are: strength and long-life due to the particular structure and formula utilized, benefit to the ecology by utilizing recycled materials which would normally be disposed of in landfills, a process of compression molding manufacture which may be economically effected to produce a high-quality product at low cost for widespread commercial appeal.

It is noted that the method of manufacture is a separate patentable invention for which a patent application will be filed.

While a particular design and compound have been shown and described, it is intended in this specification to broadly claim all equivalent structures and compounds which would reasonably occur to those of skill in the art.

The invention is further defined by the claims appended hereto.

We claim:

1. A roofing tile (10) having top and bottom edges (15, 16), a left side edge (11) and a right side edge (12), at least two peaks (21, 22) running from said top edge (15) to said bottom edge (16), said tile having a central valley portion (31) and right and left partial valley portions (32, 33), wherein said tile left side edge (11) has a pair of connecting ridges (51, 52) formed thereon for providing a joining function, wherein said tile right side edge (12) has a pair of connecting ridges (53, 54) formed on a bottom portion thereof, wherein strengthening ridges (41, 42) are formed at a top portion (15) of said tile, wherein said tile (10) includes further strengthening ridges (43, 44) at a central portion thereof and further strengthening ridges (45, 46) at a lower edge (16) thereof, wherein all of said components are formed in a single compression molded piece for overall unit strength and wherein the width of the tile is on the order of 12–13 inches to provide an extra-wide curved tile configuration, wherein all of the following recycled materials, binders and fire retardant materials are used in a mixture to form the tile:

A) ethylene propylene diene monomers,

B) styrene butadiene rubber,

C) ethylene vinyl acetate and ultra low density polyethylene,

D) aluminum tri-hydrate,

E) high density polyethylene.

* * * * *